US012338568B2

(12) United States Patent
Kwon et al.

(10) Patent No.: US 12,338,568 B2
(45) Date of Patent: Jun. 24, 2025

(54) CLOTHES PROCESSING APPARATUS

(71) Applicant: LG Electronics Inc., Seoul (KR)

(72) Inventors: Yongwoo Kwon, Seoul (KR); Jungsang You, Seoul (KR); Donghyun Jin, Seoul (KR)

(73) Assignee: LG Electronics Inc., Seoul (KR)

( * ) Notice: Subject to any disclaimer, the term of this patent is extended or adjusted under 35 U.S.C. 154(b) by 682 days.

(21) Appl. No.: 17/422,672

(22) PCT Filed: Jan. 31, 2020

(86) PCT No.: PCT/KR2020/001531
§ 371 (c)(1),
(2) Date: Jul. 13, 2021

(87) PCT Pub. No.: WO2020/159315
PCT Pub. Date: Aug. 6, 2020

(65) Prior Publication Data

US 2022/0120024 A1 Apr. 21, 2022

(30) Foreign Application Priority Data

Feb. 1, 2019 (KR) ..... 10-2019-0014064
May 17, 2019 (KR) ..... 10-2019-0058238
(Continued)

(51) Int. Cl.
*D06F 39/14* (2006.01)
*D06F 25/00* (2006.01)
*D06F 58/20* (2006.01)

(52) U.S. Cl.
CPC ..... *D06F 39/14* (2013.01); *D06F 25/00* (2013.01); *D06F 58/20* (2013.01)

(58) Field of Classification Search
CPC ..... D06F 39/14; D06F 25/00; D06F 58/20
(Continued)

(56) References Cited

U.S. PATENT DOCUMENTS 6,256,823 B1 7/2001 Kronbetter et al.
8,148,633 B2 4/2012 Hung
(Continued)

FOREIGN PATENT DOCUMENTS

CN 1475621 2/2004
CN 1607290 4/2005
(Continued)

OTHER PUBLICATIONS

CN208293271U—machine translation (Year: 2018).*
(Continued)

*Primary Examiner* — Tinsae B Ayalew
(74) *Attorney, Agent, or Firm* — Fish & Richardson P.C.

(57) ABSTRACT

A clothes processing apparatus includes a body including a front panel having a clothes inlet and a clothes accommodation unit for accommodating clothes introduced through the clothes inlet, an outer frame including a door rotatably installed on the front panel so as to open and close the clothes inlet, a front glass attached to the front surface of the outer frame so as to cover an opening; an inner frame coupled to the rear surface of the outer frame and oriented to face the inside of the body, and a mounting guide protruding from the outer circumferential portion of the outer frame so as to surround the outer circumferential surface of the front glass. The mounting guide has an inner circumferential surface disposed on the outer circumferential surface of the front glass with a clearance therebetween, to protect the outer circumferential surface of the front glass from an external impact.

20 Claims, 8 Drawing Sheets

(30) Foreign Application Priority Data

Oct. 16, 2019 (KR) ..... 10-2019-0128703
Jan. 31, 2020 (KR) ..... 10-2020-0011873

(58) Field of Classification Search
USPC ..... 34/108
See application file for complete search history.

(56) References Cited

U.S. PATENT DOCUMENTS

| | | | | |
|---|---|---|---|---|
| 8,555,681 | B2 | 10/2013 | Caudevilla De Sola et al. | |
| 8,570,737 | B2 | 10/2013 | Rayner | |
| 2004/0177656 | A1 | 9/2004 | Kwon | |
| 2005/0138974 | A1 | 6/2005 | Ha et al. | |
| 2005/0262681 | A1 | 12/2005 | Yoon et al. | |
| 2007/0051012 | A1 | 3/2007 | Schoene | |
| 2007/0125132 | A1 | 6/2007 | Hwang | |
| 2007/0137261 | A1 | 6/2007 | Kwon | |
| 2007/0240456 | A1 | 10/2007 | Byun et al. | |
| 2008/0223085 | A1 | 9/2008 | Park | |
| 2008/0302141 | A1 | 12/2008 | Chung | |
| 2009/0064593 | A1* | 3/2009 | Ha | D06F 39/14 49/400 |
| 2009/0066205 | A1* | 3/2009 | Park | D06F 34/28 312/228 |
| 2009/0165391 | A1 | 7/2009 | Kocak et al. | |
| 2011/0025178 | A1 | 2/2011 | Schöne | |
| 2011/0050059 | A1 | 3/2011 | Kim et al. | |
| 2015/0000200 | A1 | 1/2015 | Kim et al. | |
| 2015/0003027 | A1 | 1/2015 | Han et al. | |
| 2016/0369445 | A1 | 12/2016 | Kim et al. | |
| 2017/0121884 | A1 | 5/2017 | Kwon et al. | |
| 2017/0121890 | A1 | 5/2017 | Kwon et al. | |
| 2017/0167070 | A1 | 6/2017 | Khamprachom et al. | |
| 2017/0183803 | A1 | 6/2017 | Kim et al. | |
| 2017/0260678 | A1 | 9/2017 | Wee et al. | |
| 2018/0002853 | A1 | 1/2018 | Anand et al. | |
| 2018/0163333 | A1 | 6/2018 | Zhang et al. | |
| 2018/0195226 | A1 | 7/2018 | Kwon et al. | |
| 2018/0216282 | A1 | 8/2018 | Lee et al. | |
| 2018/0274155 | A1 | 9/2018 | Anand et al. | |
| 2018/0363198 | A1 | 12/2018 | Gim | |
| 2019/0071815 | A1 | 3/2019 | Woodham et al. | |

FOREIGN PATENT DOCUMENTS

| | | |
|---|---|---|
| CN | 1880559 | 12/2006 |
| CN | 1940167 | 4/2007 |
| CN | 101671930 | 3/2010 |
| CN | 104420137 | 3/2015 |
| CN | 104975466 | 10/2015 |
| CN | 204780322 | 11/2015 |
| CN | 105937137 | 9/2016 |
| CN | 106012423 | 10/2016 |
| CN | 106032611 | 10/2016 |
| CN | 106133231 | 11/2016 |
| CN | 205907515 | 1/2017 |
| CN | 107287850 | 10/2017 |
| CN | 107974810 | 5/2018 |
| CN | 208293271 | 12/2018 |
| CN | 109112795 | 1/2019 |
| DE | 29721320 | 2/1998 |
| DE | 202014010568 | 1/2016 |
| EP | 0870861 | 10/1998 |
| EP | 1309749 | 12/2005 |
| EP | 1860228 | 11/2007 |
| EP | 2147996 | 1/2010 |
| EP | 2161364 | 3/2010 |
| EP | 1522623 | 5/2010 |
| EP | 2677076 | 12/2013 |
| EP | 2740833 | 4/2017 |
| EP | 3162945 | 5/2017 |
| EP | 3181750 | 6/2017 |
| EP | 3332060 | 6/2018 |
| EP | 3363945 | 8/2018 |
| EP | 3875670 | 9/2021 |
| FR | 2691298 | 11/1993 |
| FR | 2733258 | 10/1996 |
| FR | 2756575 | 6/1998 |
| GB | 8309969 | 5/1983 |
| GB | 2118580 | 11/1983 |
| GB | 2320507 | 6/1998 |
| JP | H0631766 | 4/1994 |
| JP | 1024130 | 1/1998 |
| JP | 2000145022 | 5/2000 |
| JP | 2005058771 | 3/2005 |
| JP | 2005160952 | 6/2005 |
| JP | 2008295957 | 12/2008 |
| JP | 2010063522 | 3/2010 |
| JP | 2012075689 | 4/2012 |
| JP | 2012223344 | 11/2012 |
| JP | 2014003293 | 1/2014 |
| JP | 2014151948 | 8/2014 |
| JP | 2016049112 | 4/2016 |
| JP | 2017038828 | 2/2017 |
| JP | 2017099993 | 6/2017 |
| JP | 2018110645 | 7/2018 |
| JP | 2018532545 | 11/2018 |
| JP | 2018536517 | 12/2018 |
| KR | 20050021057 | 3/2005 |
| KR | 100595180 | 7/2006 |
| KR | 20070002458 | 1/2007 |
| KR | 20070044599 | 4/2007 |
| KR | 20070070780 | 7/2007 |
| KR | 20100019091 | 2/2010 |
| KR | 20110013011 | 2/2011 |
| KR | 101138697 | 6/2012 |
| KR | 101156707 | 6/2012 |
| KR | 20140006647 | 1/2014 |
| KR | 20150003592 | 1/2015 |
| KR | 20150006264 | 1/2015 |
| KR | 20160041886 | 4/2016 |
| KR | 101708350 | 2/2017 |
| KR | 101708351 | 2/2017 |
| KR | 101708352 | 2/2017 |
| KR | 20180089992 | 8/2018 |
| KR | 20180136086 | 12/2018 |
| KR | 20180136094 | 12/2018 |
| KR | 20180136095 | 12/2018 |
| KR | 20180136102 | 12/2018 |
| RU | 2355836 | 5/2009 |
| WO | WO2015144236 | 10/2015 |
| WO | WO2017020959 | 2/2017 |
| WO | WO2018077130 | 5/2018 |
| WO | WO2018121942 | 7/2018 |
| WO | WO2018138946 | 8/2018 |

OTHER PUBLICATIONS

KR Office Action in Korean Appln. No. 10-2020-0011873, dated Jun. 15, 2021, 9 pages (with English translation).
AU Office Action in Australian Appln. No. 2020200522, dated Sep. 17, 2020, 8 pages.
AU Office Action in Australian Appln. No. 2020200534, dated Aug. 17, 2020, 6 pages.
AU Office Action in Australian Appln. No. 2020200550, dated Sep. 2, 2020, 9 pages.
EP Extended European Search Report in EP Appln. No. 20152156.4, dated Jun. 24, 2020, 9 pages.
EP Extended European Search Report in EP Appln. No. 20152169.7, dated Jul. 1, 2020, 10 pages.
EP Extended European Search Report in EP Appln. No. 20152181.2, dated Jun. 24, 2020, 10 pages.
EP Extended European Search Report in EP Appln. No. 20152188.7, dated Jun. 20, 2020, 10 pages.
EP Extended European Search Report in European Appln. No. 20152172.1, dated Jul. 1, 2020, 10 pages.
EP Extended European Search Report in European Appln. No. 20152181.2, dated Jun. 6, 2020, 10 pages.
JP Office Action in Japanese Appln. No. 2020-013079, dated Feb. 2, 2021, 10 pages (with English translation).

(56) References Cited

OTHER PUBLICATIONS

JP Office Action in Japanese Appln. No. 2020-013134, dated Dec. 15, 2020, 14 pages (with English translation).
JP Office Action in Japanese Appln. No. 2020-013137, dated Dec. 15, 2020, 14 pages (with English translation).
KR Office Action in Korean Appln. No. 10-2019-0124785, dated Jun. 15, 2021, 12 pages (with English translation).
KR Office Action in Korean Appln. No. 10-2019-0127328, dated Jun. 15, 2021, 12 pages (with English translation).
KR Office Action in Korean Appln. No. 10-2019-0127330, dated Jun. 15, 2021, 10 pages (with English translation).
KR Office Action in Korean Appln. No. 10-2019-0127998, dated Jun. 15, 2021, 12 pages (with English translation).
RU Decision to Grant in Russian Appln. No. 2020102678, dated May 25, 2020, 22 pages (with English translation).
RU Decision to Grant in Russian Appln. No. 2020103239, dated Apr. 21, 2020, 22 pages (with English translation).
RU Decision to Grant in Russian Appln. No. 2020103240, dated May 15, 2020, 21 pages (with English translation).
RU Decision to Grant in Russian Appln. No. 2020103247, dated Aug. 25, 2020, 22 pages (with English translation).
RU Office Action in RU Appln. No. 2020103247, dated Jun. 18, 2020, 19 pages (with English translation).
Office Action in U.S. Appl. No. 16/776,695, dated Jan. 14, 2022, 51 pages.
Office Action in U.S. Appl. No. 16/776,739, dated Jan. 24, 2022, 60 pages.
Office Action in Chinese Appln. No. 201911356954.5, dated May 7, 2022, 11 pages (with English translation).
Non-Final Office Action in U.S. Appl. No. 16/776,779, dated Mar. 2, 2022, 55 pages.
Office Action in U.S. Appl. No. 16/776,780, dated May 24, 2022, 59 pages.
Office Action in Chinese Appln. No. 201911265766.1, dated Mar. 21, 2022, 15 pages (with English translation).
Office Action in Chinese Appln. No. 201911291955.6, dated Mar. 3, 2022, 17 pages (with English translation).
Office Action in Chinese Appln. No. 201911338352.7, dated Mar. 4, 2022, 15 pages (with English translation).
Office Action in Chinese Appln. No. 201911338904.4, dated Mar. 17, 2022, 22 pages (with English translation).
Office Action in Chinese Appln. No. 201911356949.4, dated Mar. 8, 2022, 16 pages (with English translation).
Office Action in Chinese Appln. No. 201911356952.6, dated Apr. 2, 2022, 17 pages (with English translation).
Office Action in German Appln. No. 102020100945.3, dated Apr. 8, 2022, 12 pages (with English translation).

* cited by examiner

CLOTHES PROCESSING APPARATUS

CROSS-REFERENCE TO RELATED APPLICATIONS

This application is a National Stage application under 35 U.S.C. § 371 of International Application No. PCT/KR2020/001531, filed on Jan. 31, 2020, which claims the benefit of Korean Application Nos. 10-2020-0011873, filed on Jan. 31, 2020, 10-2019-0128703, filed on Oct. 16, 2019, 10-2019-0058238, filed on May 17, 2019, and 10-2019-0014064, filed on Feb. 1, 2019. The disclosures of the prior applications are incorporated by reference in their entirety.

BACKGROUND

1. Technical Field

The present disclosure relates to a clothes processing apparatus having a mounting guide that surrounds an outer circumferential surface of a front glass of a door to protect the front glass from impact or the like.

2. Description of the Related Art

In general, a clothes processing apparatus may include an apparatus having a function of washing or drying laundry. In addition, the clothes processing apparatus may be configured to have both a washing function and a drying function of the laundry.

The clothes processing apparatus may include a main body having a laundry inlet port, a door configured to open and close the laundry inlet port, and a laundry accommodating portion provided in the main body.

The door may include a door frame, a front glass attached to a front surface of the door frame, and a door window mounted on the door frame to protrude through the laundry input port.

The door frame may include an outer frame disposed toward an outside of the main body, and an inner frame disposed toward an inside of the main body when the door is closed.

The prior art Korean Patent No. 10-0595180 (granted on Jun. 23, 2006; hereinafter, Patent Document 1) discloses a door of a laundry dryer/drum washing machine.

According to Patent Document 1, a rim protruding to a front side of the door to surround an outer circumferential surface of an outer window attached to a front surface of an outer frame may be provided.

The rim may protrude to correspond to a thickness of the outer window, and may be disposed to completely cover an outer circumferential surface of the outer window in a thickness direction.

However, Patent Document 1 has a problem that when a protruding length of the rim protruding in a thickness direction of the outer window increases, a thickness of the rim increases to reinforce the strength of the rim, thereby increasing a size of the door frame.

The prior art Korean Patent No. 10-1708352 (granted on Feb. 14, 2017; hereinafter Patent Document 2) discloses a clothes processing apparatus.

According to Patent Document 2, an outer circumference of the inner frame may define a mounting guide that protrudes from a front surface of the outer frame to cover a side surface of a door cover.

The mounting guide of Patent Document 2 is disposed to be inclined downward from a front surface of the outer frame toward a side surface of the door cover.

However, the downwardly inclined structure of the mounting guide has the following problems.

In other words, due to the overweight of the front glass and the weakening of an adhesive force between the front glass and the outer frame, the front glass moves along the downwardly inclined inner surface of the mounting guide and is released from an outside of the door frame, thereby causing the front glass to be broken.

In addition, a sealant coating portion filled with a sealant for bonding the front glass and a plurality of sealant collecting portions spaced apart at inner and outer sides of the sealant coating portion to collect the sealant leaked from the sealant coating portion are disposed on a front surface of the outer frame of Patent Document 2.

However, although the sealant coating portion and the sealant collecting portions reduce a thickness of the outer frame to weaken the rigidity of the outer frame, Patent Document 1 does not have a structure for compensating for the rigidity of the outer frame.

SUMMARY

The present disclosure has been made to solve the problems in the related art, and a first aspect of the present disclosure is to provide a clothes processing apparatus capable of supporting a front glass while reducing a size of a mounting guide that surrounds an outer circumferential surface of the front glass.

A second aspect of the present disclosure is to provide a clothes processing apparatus capable of preventing a sealant from leaking from an inside of an outer frame and preventing moisture from infiltrating into the front glass.

A third aspect of the present disclosure is to provide a clothes processing apparatus having a structure capable of securing the rigidity of a mounting guide.

A fourth aspect of the present disclosure is to provide a clothes processing apparatus capable of compensating for the rigidity of an outer frame vulnerable due to an adhesive filling groove.

A fifth aspect of the present disclosure is to provide a clothes processing apparatus having an inner surface structure of the mounting guide capable of securing a sufficient supporting force with respect to the weight of the front glass.

In order to achieve the foregoing first objective, a clothes processing apparatus according to the present disclosure may include a main body having a front panel disposed with a laundry inlet port and a laundry accommodating portion that accommodates laundry loaded through the laundry inlet port; and a door rotatably provided on the front panel to open and close the laundry inlet port, wherein the door includes an outer frame provided with an opening portion, and disposed toward an outer side of the main body; a front glass coupled to a front surface of the outer frame to cover the opening portion; an inner frame coupled to a rear surface of the outer frame, and disposed toward an inner side of the main body; and a mounting guide protruding from an outer circumferential portion of the outer frame so as to surround an outer circumferential surface of the front glass, an inner circumferential surface of the mounting guide being disposed through a gap with an outer circumferential surface of the front glass.

According to an example associated with the present disclosure, the gap may be 0.1 mm to 1.0 mm.

Preferably, the gap may be 0.5 mm to 0.7 mm.

According to an example associated with the present disclosure, the mounting guide may be formed integrally with the outer frame, and the mounting guide and the outer frame may be injection-molded with a plastic material.

According to an example associated with the present disclosure, the mounting guide may be defined in a ring shape.

According to an example associated with the present disclosure, a width of the mounting guide may be 1.5 mm to 6.0 mm, and the width of the mounting guide may be one half of the difference between an outer diameter of the mounting guide and an inner diameter of the mounting guide.

Preferably, the width of the mounting guide may be 2.5 mm to 4.5 mm.

According to an example associated with the present disclosure, the mounting guide may define an outermost portion of the outer frame, and the mounting guide may include an inner portion protruding toward a front side of the outer frame in a thickness direction of the front glass so as to cover part of the outer circumferential surface of the front glass; a front portion extending in a radial direction from the inner portion, and defined in a flat shape; a round portion disposed to be rounded in an arc shape on the front portion; and an inclined portion disposed to be inclined to increase in diameter from the round portion toward the inner frame.

According to an example associated with the present disclosure, a radial width from the inner portion to an outer circumferential end of the front portion may be 2.5 mm or more, a radial width from the inner portion to an outer circumferential end of the inclined portion may be 4.5 mm or less, and a radial width from the outer circumferential end of the front portion to an outer circumferential end of the round portion may be 2 mm or less.

According to an example associated with the present disclosure, a radial width of the front portion, an arc length of the round portion, and a length of the inclined portion may be different from one other, and the arc length of the round portion may be larger than the radial width of the front portion, and the length of the inclined portion may be larger than the radial width of the front portion.

According to an example associated with the present disclosure, radial widths of the front portion, the round portion, and the inclined portion may be different from one another, and a radial width from the inner portion to an outer circumferential end of the inclined portion may be larger than a width from the inner portion to an outer circumferential end of the front portion.

According to an example associated with the present disclosure, the door may include a flat portion provided on a front surface of the outer frame and disposed with an adhesive filling groove for the attachment of the front glass, and the mounting guide may be disposed perpendicular to the flat portion.

According to an example associated with the present disclosure, the mounting guide may cover at least two thirds of a thickness of the front glass.

According to an example associated with the present disclosure, the inner portion may cover at least two thirds of the thickness of the front glass.

According to an example associated with the present disclosure, the front glass may include a first curved portion disposed at a front side thereof in a thickness direction and a straight portion extending toward a rear side thereof from the first curved portion, and the inner portion may cover at least part of the straight portion.

According to an example associated with the present disclosure, the mounting guide may cover all of the straight portion.

According to an example associated with the present disclosure, the front glass may further include a second curved portion extending symmetrically with the first curved portion toward a rear side thereof in a thickness direction of the front glass from the straight portion, the first curved portion may be open from the inner portion, and the inner portion may protrude to cover the straight portion and the second curved portion.

According to an example associated with the present disclosure, the front glass may be defined in a disc shape in which front and rear surfaces thereof are respectively flat.

According to an example associated with the present disclosure, the outer frame may include a flat portion having an adhesive filling portion that fills an adhesive for the attachment of the front glass, wherein the adhesive filling portion includes an adhesive filling groove filled with an adhesive; and a plurality of adhesive overflow grooves disposed radially spaced apart from each other on the flat portion with the adhesive filling groove interposed therebetween to accommodate the adhesive overflowing from the adhesive filling groove.

According to an example associated with the present disclosure, the clothes processing apparatus may include a first hook protruding from an outer circumferential portion of the outer frame toward the inner frame; and a second hook protruding from an outer circumferential portion of the inner frame toward the outer frame, and coupled to the first hook by an interference fit.

The effects of a clothes processing apparatus according to the present disclosure will be described as follows.

First, a mounting guide may protrude from an outer circumference of an outer frame to surround an outer circumferential surface of a front glass, but the mounting guide may be disposed to cover part (a straight portion and an inner curved portion) of the outer circumferential of the front glass, thereby supporting the glass while reducing a size of the mounting guide.

If the mounting guide completely covers a thickness of the outer circumferential surface of the front glass, then a protruding length increases in a thickness direction of the front glass, and a thickness of the mounting guide must be disposed to have a larger thickness from a front side to a rear side of the mounting guide so as to reinforce the strength of the mounting guide.

For example, when the front glass has a first curved portion (outer curved portion), a straight portion and a second curved portion (inner curved portion) from the outside toward the inside in a thickness direction, the mounting guide may be configured to cover the straight portion of the outer circumferential surface of the front glass. The length in which the mounting guide protrudes in the thickness direction of the front glass is configured to cover two thirds of the outer circumferential surface of the front glass. According to this structure, a size of the mounting guide may be reduced while ensuring a support force of the front glass.

Second, the mounting guide may protrude from the outer circumference of the front glass to surround the outer circumferential surface of the front glass, thereby not only preventing an adhesive applied to an inner side of the outer frame from leaking to an outer side of the outer frame, but also preventing moisture from infiltrating into an inner side of the outer frame.

Third, the outer circumference of the outer frame may protrude from a front surface of the outer frame to surround the front glass so as to define a mounting guide, and an inner surface of the mounting guide may be disposed in parallel to a side surface of the front glass in a thickness direction of the front glass, thereby securing sufficient support of the outer frame to the front glass even when an adhesive force between the front glass and the front surface of the outer frame is weakened.

Fourth, a thickness of the mounting guide may increase from one point of a front surface or a side surface of the front glass toward a rear surface of the front glass, thereby securing itself the rigidity of the mounting guide capable of withstanding the weight of the front glass.

Fifth, a structure such as reinforcing ribs may protrude from a rear surface of the outer frame to overlap with an adhesive filling groove in a thickness direction of the outer frame, thereby structurally reinforcing the rigidity of the outer frame from weakening due to the adhesive filling groove.

Sixth, the outer frame and the inner frame may be coupled to each other by a hook fastening structure, thereby improving a coupling force between the outer frame and the inner frame even without drilling fastening holes in the front glass.

Seventh, each of the first hook of the outer frame and the second hook of the inner frame may have a wedge-shaped hook protrusion, and each hook protrusion may be defined such that an inclination of the second inclined surfaces in contact with each other subsequent to fastening the first hook and the second hook is higher than that of the first inclined surfaces in contact with each other prior to fastening, thereby allowing the second hook to easily enter an inside of the first hook while restricting the second hook from being separated from the first hook.

Eighth, an elastic groove may be disposed on a rear surface of the outer frame to guide the first hook to be deformed radially outward when the first hook of the outer frame and the second hook of the inner frame are fastened to each other, thereby allowing the second hook to easily enter an inside of the first hook to improve assembly performance between the outer frame and the inner frame.

Ninth, a pressing portion may include a plurality of pressing ribs, a connecting rib and a plurality of support ribs on a rear surface of the outer frame, and the pressing ribs may press the second hook when the first hook of the outer frame and the second hook of the inner frame are fastened to each other, thereby preventing the second hook from being deformed radially inward with respect to the first hook or in the direction of gravity and more firmly maintaining a fastening force between the first hook and the second hook even though the weight of the front glass accounts for a relatively large proportion of the total weight of a door.

Tenth, the connecting rib may protrude from a rear surface of the outer frame to connect the plurality of pressing ribs, and defined in a ring shape along a circumferential direction, thereby enhancing a support strength of the outer frame and a pressing force of the plurality of pressing ribs with respect to the front glass.

Eleventh, the plurality of support ribs may protrude from a rear surface of the outer frame, and may be integrally connected to an inner circumferential surface of the connecting rib, thereby further enhancing a supporting force to the connecting rib and the pressing ribs.

Twelfth, the mounting guide may be disposed to protrude from an outer circumference of the outer frame toward a front side of the door to surround the outer circumferential surface of the front glass, and a gap may be disposed between an inner circumferential surface of the mounting guide and an outer circumferential surface of the front glass, thereby preventing a breakage of the outer circumferential surface of the front glass, and protecting a side surface of the front glass from external impact.

DETAILED DESCRIPTION OF THE EMBODIMENTS

Figure 1:
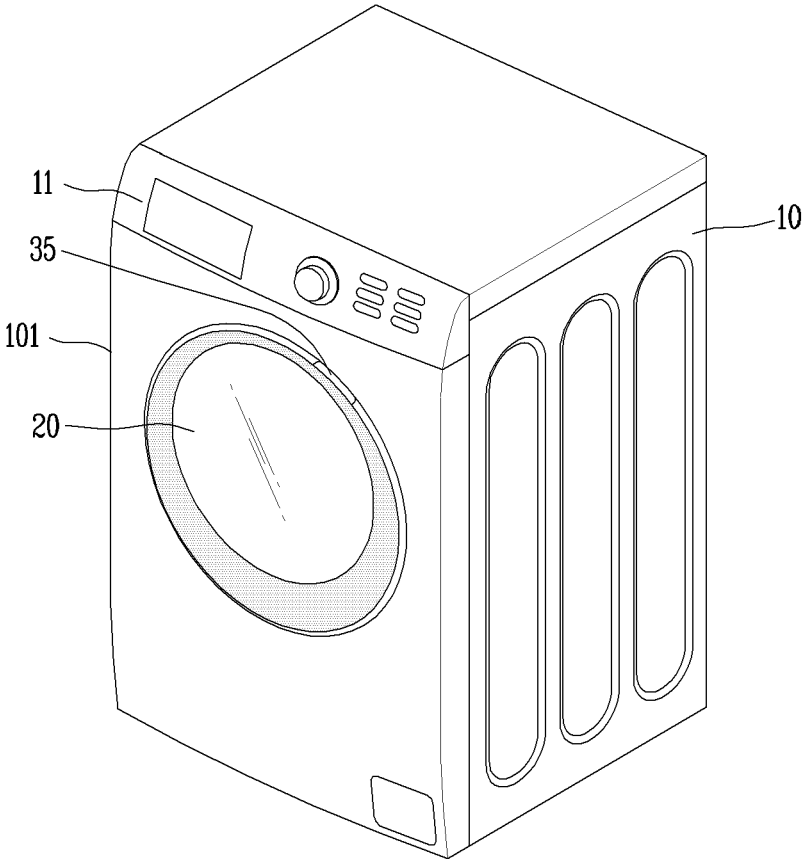
FIG. 1 is a perspective view showing a clothes processing apparatus according to the present disclosure.

Hereinafter, the embodiments disclosed herein will be described in detail with reference to the accompanying drawings, and the same or similar elements are designated with the same numeral references regardless of the numerals in the drawings and their redundant description will be omitted. The suffixes "module" and "unit" for constituent elements used in the following description are given or used interchangeably in consideration of only the ease of preparation of the specification, and do not have distinct meanings or roles from each other. In describing the embodiments disclosed herein, moreover, the detailed description will be omitted when specific description for publicly known technologies to which the invention pertains is judged to obscure the gist of the present disclosure. Also, it should be understood that the accompanying drawings are merely illustrated to easily explain the concept of the invention, and therefore, they should not be construed to limit the technological concept disclosed herein by the accompanying drawings, and the concept of the present disclosure should be construed as being extended to all modifications, equivalents, and substitutes included in the concept and technological scope of the invention.

Though the terms including an ordinal number such as first, second, etc. may be used herein to describe various elements, the elements should not be limited by those terms. The terms are used merely for the purpose to distinguish an element from another element.

It will be understood that when an element is referred to as being "connected with" another element, the element can be directly connected with the other element or intervening elements may also be present. On the contrary, in case where an element is "directly connected" or "directly linked" to another element, it should be understood that any other element is not existed therebetween.

A singular representation may include a plural representation as far as it represents a definitely different meaning from the context.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, constituent elements, components or combinations thereof are not excluded in advance.

FIG. 1 is a perspective view showing a clothes processing apparatus according to the present disclosure.

The clothes processing apparatus of the present disclosure may include a main body 10, a tub, a drum, and a door 12.

The main body 10 may define an outer shape of the clothes processing apparatus. The main body 10 may be defined in a rectangular parallelepiped shape.

The main body 10 includes a front panel 101 defining a front surface of the clothes processing apparatus, a rear panel defining a rear surface of the clothes processing apparatus, side panels defining both sides of the clothes processing apparatus, a top panel defining a top surface of the clothes processing apparatus, and a bottom panel defining a bottom surface of the clothes processing apparatus.

The rear panel and the left and right side panels may be defined in a "ㄷ" shape by bending one rectangular plate, thereby improving the structural rigidity of the main body 10.

Figure 5:
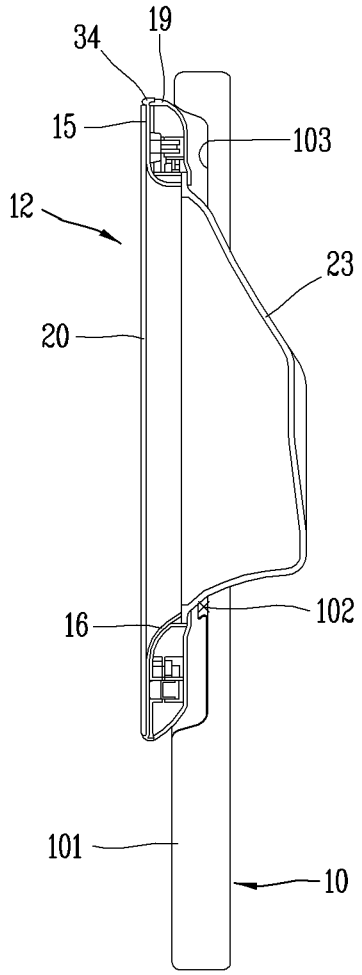
FIG. 5 is a cross-sectional view showing a state in which a door is mounted on a front panel of a main body to close a laundry input port.

A laundry inlet port 102 may be defined in a circular shape on the front panel 101 (see FIG. 5). The laundry inlet port 102 may be defined to pass through the front panel 101 so as to put laundry into the laundry accommodating portion through the laundry inlet port 102.

The laundry inlet port 102 may be disposed in the front panel 101 such that a recess portion 103 is recessed toward an inside of the main body 10 to surround the laundry inlet port 102. The laundry inlet port 102 is disposed to pass through an inside of the recess portion 103. Part of the door 12 may be accommodated in the recess portion 103.

The door 12 may be rotatably coupled to the front panel 101 by a hinge 25 to open and close the laundry input port 102.

A laundry accommodating portion may be provided inside the main body 10. The laundry accommodating portion may include a drum to perform a drying function, or a tub and a drum to perform washing and drying functions together.

In the present embodiment, in order to perform a drying function with washing, a tub and a drum may be provided inside the main body 10. The tub may be defined in a cylindrical shape, the central shaft of the tub in a length direction may be disposed horizontally or in an inclined manner at a predetermined angle. Wash water may be stored inside the tub.

The drum may be rotatably provided inside the tub.

A gasket may be provided at a front end portion of the tub to communicate with the laundry inlet port 102 so as to prevent the wash water stored inside the tub from being leaked into an accommodation space of the main body 10.

The drum may be provided to be rotatable with respect to the tub inside the tub.

A front portion of the drum may be open to be connected in communication with the laundry input port 102, and laundry may be accommodated inside the drum through the laundry input port 102.

A drive motor may be provided on a rear surface of the tub, and the drive motor may be connected to a rotating shaft on a rear surface of the drum to rotate the drum by transmitting the power of the drive motor to the drum through the rotating shaft as the drive motor is driven.

A plurality of through holes may be arranged on a circumferential surface of the drum to allow a fluid such as wash water to enter and exit the drum through the plurality of through holes.

The drum may be configured to have a plurality of lifters therein to rotate laundry accommodated inside the drum, thereby performing washing and drying functions.

The control unit 11 may be provided in the main body 10 or provided in the door 12. In the present embodiment, it is shown a state that the control unit 11 is located above the front panel 101 of the main body 10.

The control unit 11 is configured to display information related to a stroke processed by the clothes processing apparatus to a user and to receive the user's operation. The control unit 11 may include a circular knob and a plurality of buttons for receiving a user's manipulation. In addition, the control unit 11 may include a display for displaying visual information.

Figure 2:
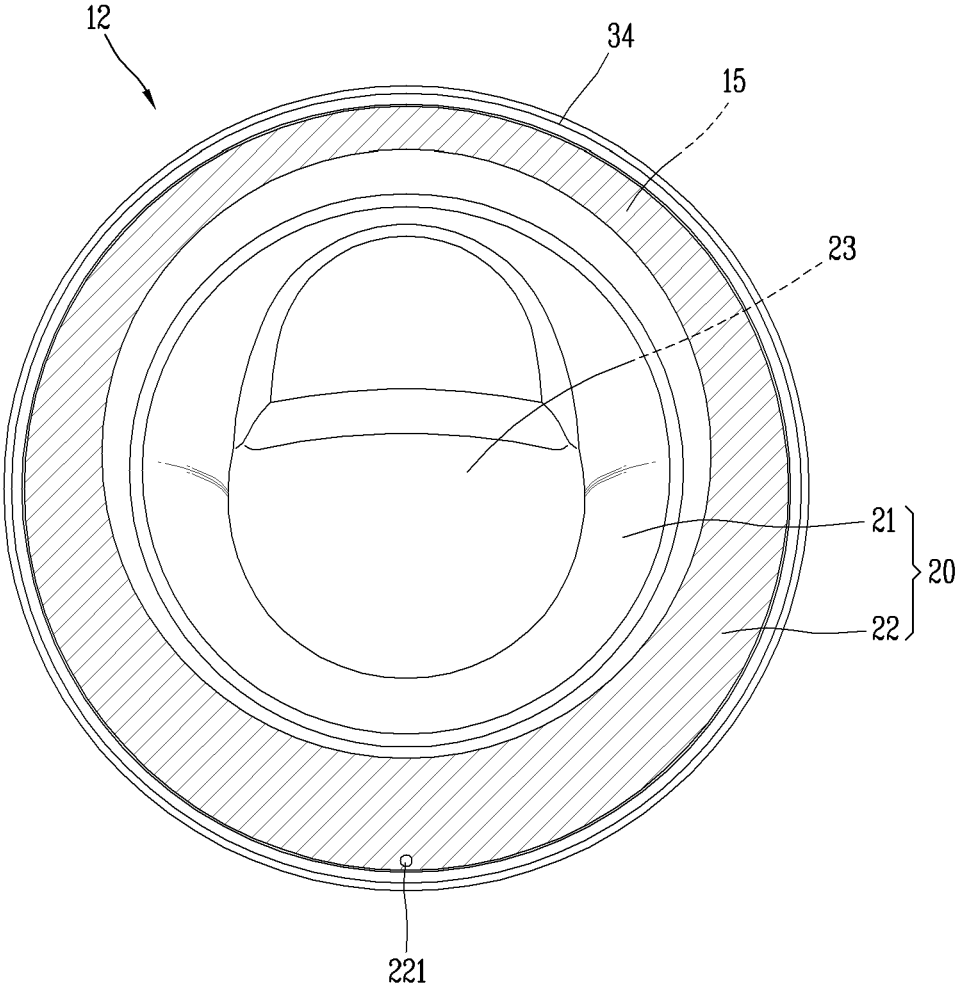
FIG. 2 is a front view showing a state in which a door is seen from the front in FIG. 1.
Figure 3:
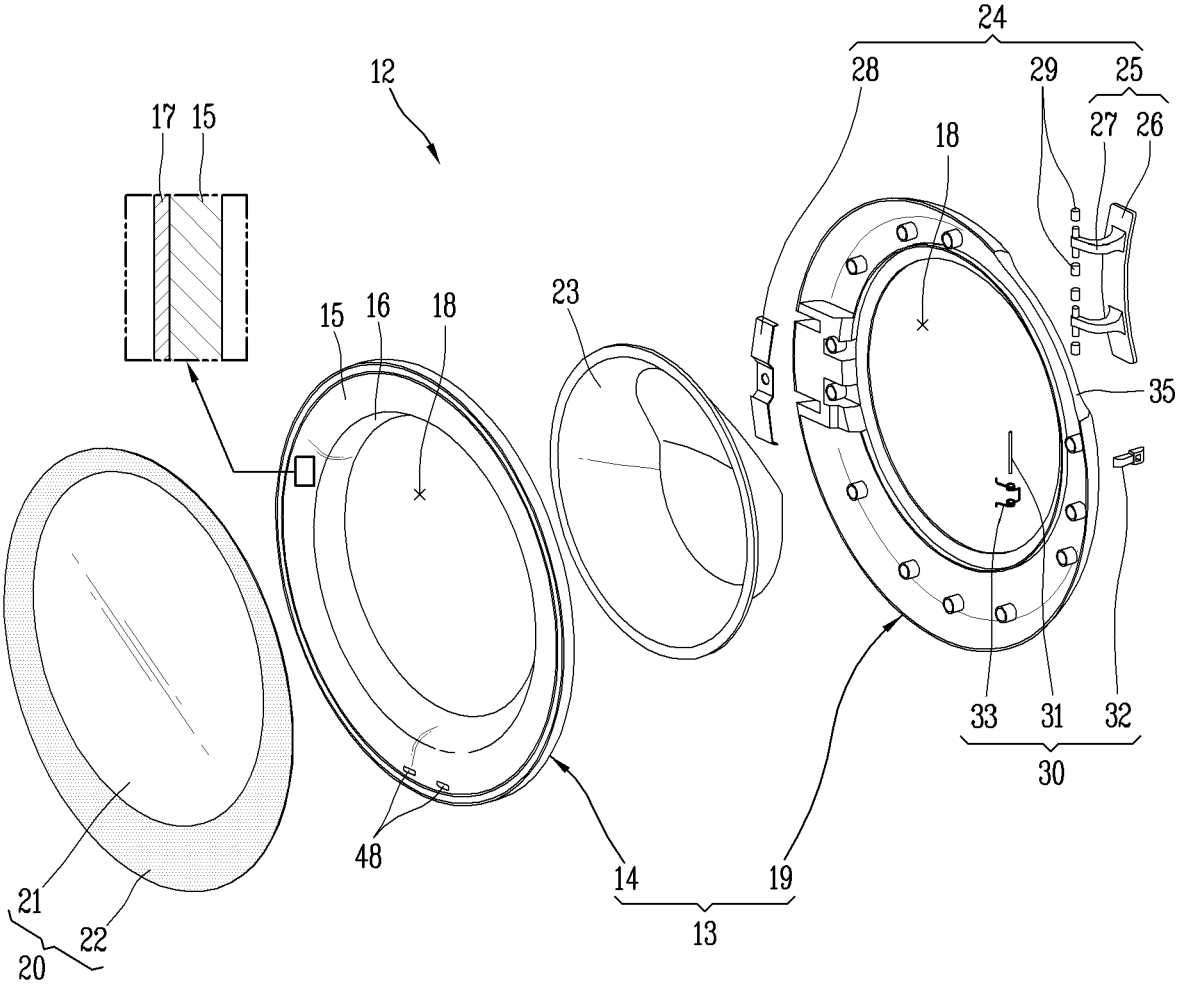
FIG. 3 is an exploded view showing a state in which the door in FIG. 2 is disassembled.

FIG. 2 is a front view showing a state in which the door 12 is seen from the front in FIG. 1, and FIG. 3 is an exploded view showing a state in which the door 12 in FIG. 2 is disassembled.

The door 12 may include a door frame 13, a door window 23, a front glass 20, a hinge unit 24, and a locking unit 30.

The door frame 13 may be defined in a ring shape.

The door frame 13 may include an outer frame 14 and an inner frame 19. The outer frame 14 and the inner frame 19 may be made of a synthetic resin material (e.g., ABS material, PC material, etc.).

Each of the outer frame 14 and the inner frame 19 may be manufactured by injection molding when made of a synthetic resin material.

The outer frame 14 and the inner frame 19 may be respectively defined in a ring shape, and overlapped and fastened to each other in a front-rear direction. A fastening structure between the outer frame 14 and the inner frame 19 will be described later in detail.

Describing the reason for the naming of the outer frame 14 and the inner frame 19, the outer frame 14 and the inner frame 13 are named as such since the outer frame 14 is disposed toward the outside of the main body 10 and the inner frame 19 is disposed toward the inside of the main body 10 based on a state in which the door 12 is closed. The outer frame 14 may be referred to as a first frame, and the inner frame 19 may be referred to as a second frame.

Circular opening portions 18 are defined to correspond to each other inside the outer frame 14 and the inner frame 19, respectively.

The opening portions 18 may be eccentrically positioned at the center of each of the outer frame 14 and the inner frame 19. For example, the center of the opening portion 18 may be positioned above the center of each of the outer frame 14 and the inner frame 19.

According to this configuration, each of the outer frame 14 and the inner frame 19 may vary in width along a circumferential direction. In other words, a distance (width) between the outer diameter and the inner diameter (the opening portion 18 diameter) of each of the outer frame 14 and the inner frame 19 may be configured to increase (widen) from the top end to the bottom end.

The center of the drum may be disposed higher than the center of height (½) of the main body 10.

The drum is fixed in a height direction of the main body 10 aside from a minute vibration due to rotation.

Consumers tend to prefer a larger size of the door 12 to the same capacity and size of the washing machine when looking at the body 10 from the front.

In addition, consumers are able to look into the drum through the door 12 and, if possible, prefer to have a wide field of view with regard to an inner space of the drum.

In order to satisfy the needs of the above-mentioned consumers, the door 12 must be enlarged downward to increase the size of the door 12 while the position of the drum is fixed.

The center of the door frame 13 must move below the center of the laundry inlet port 102 or the opening portion 18. Similarly, the center of the door frame 13 may move downward with respect to the door window 23 positioned to correspond to the opening portion 18.

In addition, in order to increase the size of the door 12, it is preferable that part of the door 12 protrudes outward from the recess portion 103. A diameter of the door 12 is preferably defined to be larger than the recess portion 103.

The front glass 20 is defined in a circular shape having a preset radius. The front glass 20 is made of a glass material.

The front glass 20 is disposed flat on the front and rear surfaces thereof.

The front glass 20 is defined in a disc shape having a constant thickness, and defined without bending even when viewed from anywhere up, down, left, or right.

As described above, the front and rear surfaces of the front glass 20 made of a glass material are disposed flat in a circular shape, thereby enhancing the quality grade of the door 12, compared to a door cover in the related art made of a synthetic resin material that has a convex front surface in an incomplete circular shape.

A transparent alignment mark 221 is defined in a non-transparent region 22. The alignment mark 221 is a structure for guiding the attachment position of the front glass 20 with respect to the outer frame 14. In the present drawing, it is shown that a circular alignment mark 221 is positioned at a lower side (6 o'clock direction) of the front glass 20. However, the present disclosure is not necessarily limited thereto. The alignment mark 221 may be formed in a polygonal shape or may be formed in a line shape. Of course, the position of the alignment mark 221 may be changed.

The front glass 20 may implement a transparent region 21, a non-transparent region 22, and an alignment mark 221 through the following layer structure.

For an example, the front glass 20 may include a glass body made of a transparent glass material and a shielding layer disposed to cover a rear surface of the glass body to define the non-transparent region 22. In this case, a portion where the shielding layer is not disposed define the transparent region 21 and the alignment mark 221. The shielding layer may be made by glass printing on a rear surface of the glass body.

For another example, the front glass 20 may include a glass body made of a transparent glass material and a film disposed to cover a rear surface of the glass body. The film may include a transparent portion disposed to have a transparency corresponding to the transparent region 21, a non-transparent portion disposed to have an opacity corresponding to the non-transparent region 22, and an alignment mark 221 disposed to have a transparency corresponding to the alignment mark 221.

For still another example, the front glass 20 may include a glass body made of a transparent glass material and a film disposed to cover a rear surface of the glass body. Here, there is a difference from the above example in that the film includes a first hole disposed to correspond to the transparent region 21, a non-transparent portion disposed to have an opacity corresponding to the non-transparent region 22, and a second hole disposed to correspond to the alignment mark 221. In other words, there is a difference in whether a portion corresponding to the transparent region 21 and the alignment mark 221 in the film is disposed to have a transparency or has a perforated shape.

The front glass 20 may be disposed to cover the opening portion 18 of the door frame 13. The front glass 20 may be bonded to a front surface of the outer frame 14 by a sealant or an adhesive.

Due to the nature of the glass material, it is easy to break when a fastening hole is drilled in the front glass 20, and thus the front glass 20 is attached to the outer frame 14 using an adhesive or the like to prevent the glass from being broken.

On the other hand, the front glass 20 made of a glass material occupies a relatively large load compared to the total load of the door 12. In order to support the load of the front glass 20, a mounting guide 34 for mounting the front glass 20 is provided on a front surface of the outer frame 14.

The mounting guide 34 serves the following three roles.

First, the mounting guide 34 may protect the front glass 20 from external impact.

Second, the mounting guide 34 may support the front glass 20.

Third, when assembling the front glass 20, a position of the front glass 20 may be guided. The main role of the mounting guide 34 is to protect the front glass 20.

In particular, the front glass 20 may be made of tempered glass. Due to the nature of the tempered glass, front and rear surfaces of the front glass 20 have a high strength, but it has a disadvantage that a circular outer circumferential surface, which is a side surface of the front glass 20, has a low strength.

In order to compensate for this, the mounting guide 34 may be disposed to protrude forward from a front outer circumferential end of the outer frame 14 to surround an outer circumferential surface of the front glass 20, thereby protecting a side surface of the front glass 20 from external impact.

Figure 9:
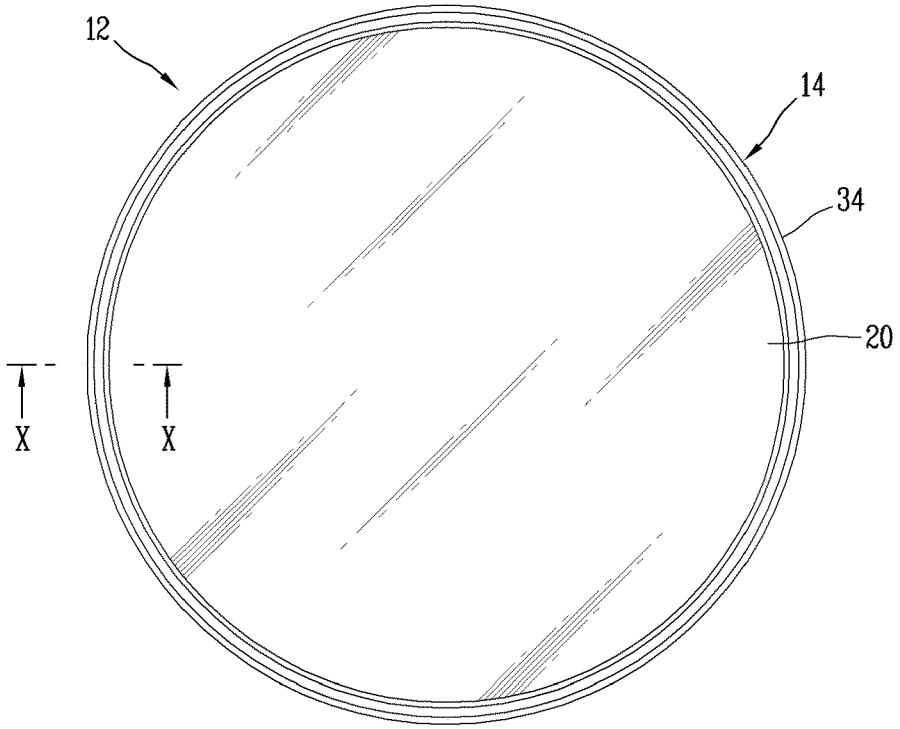
FIG. 9 is a front view showing a state in which a front glass is mounted on an inner side of a mounting guide according to the present disclosure.
Figure 10:
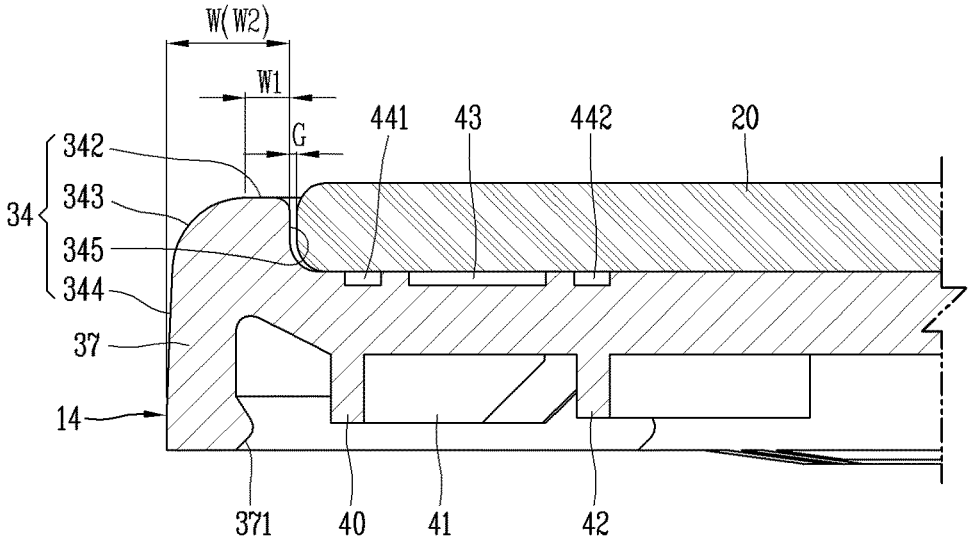
FIG. 10 is a cross-sectional view taken along line X-X in FIG. 9.

FIG. 9 is a front view showing a state in which the front glass 20 is mounted on an inner side of the mounting guide 34 according to the present disclosure. FIG. 10 is a cross-sectional view taken along line X-X in FIG. 9.

The outer frame 14 may be made of a plastic material. The outer frame 14 may be manufactured by plastic injection molding. For example, the outer frame 14 may be formed by chromium plating (or painting) on an ABS injection product. The mounting guide 34 may be integrally formed on an outer circumference of the outer frame 14.

The front glass 20 may be mounted at an inner side of the mounting guide 34. A gap (G) may be disposed between an inner circumferential surface of the mounting guide 34 and an outer circumferential surface of the front glass 20.

The gap (G) between the mounting guide 34 and the front glass 20 is a margin space for preventing the outer circumferential surface of the front glass 20 from cracking (self-explosion phenomenon of tempered glass) due to the deformation of a plastic injection product of the outer frame 14.

Since plastic and glass have different degrees of deformation due to heat due to the characteristics of the materials, an outer circumferential surface of the front glass 20 may be broken due to deformation of the injection product of the plastic.

The gap (G) between the mounting guide 34 and the front glass 20 may range from 0.1 mm to 1.0 mm.

When the gap (G) is less than 0.1 mm, the front glass 20 may be broken due to the deformation of the plastic injection product.

When the gap (G) is larger than 1.0 mm, the gap (G) may be visible when the door is viewed from the front, or a foreign object may be caught in the gap (G). Furthermore, when the gap (G) is too large, the front glass 20 may be biased to one side from an inner center of the mounting guide 34.

In addition, the mounting guide 34 may surround an outer circumferential surface of the front glass 20 to support a load of the front glass 20.

Preferably, the gap (G) between the mounting guide 34 and the front glass 20 is preferably within a range of 0.5 mm to 0.7 mm. The reason is to manage a size of the gap within 1 mm because the one side may increase by 1 mm or more when the front glass 20 is biased.

When viewing the door from the front, the mounting guide 34 may be defined in a ring shape. The smaller a width (W) of the mounting guide 34 is compared to a diameter of the door 12, the better. This is because, as the width (W) of the mounting guide 34 decreases compared to the same size of the door, the diameter of the front glass 20 can be increased. The mounting guide 34 may be at a level of 3.5% of the diameter of the door.

The width (W) of the mounting guide 34 denotes one half of the difference between an outer diameter (D1) and an inner diameter (D2) of the mounting guide 34 along a radial center line that passes through the center of the outer frame 14 in a radial direction. In other words, the width of the mounting guide 34 is W=(D2−D1)/2.

The width (W) of the mounting guide 34 may be uniformly defined in a circumferential direction.

The width (W) of the mounting guide 34 may be 1.5 mm to 6.0 mm.

The width (W1) of the mounting guide 34 is preferably at least 1.5 mm in consideration of a thickness (3.2 mm) of the front glass 20. When the width (W1) of the mounting guide 34 is too small, the resolution of the mold is not managed, and thus it is impossible to mold.

Here, the minimum value of the width (W1) of the mounting guide 34 denotes the width (W1) of a portion defined in a plane above the mounting guide 34 in the cross-sectional view of FIG. 10.

The width (W2) of the mounting guide 34 is preferably at most 6.0 mm. When the width (W2) of the mounting guide 34 is too large, a problem of shrinking occurs during plastic molding, thereby making it difficult to accurately manage the dimensions of the mounting guide 34.

Furthermore, when the width of the mounting guide is too large, there is a problem that the appearance is not elegant.

Here, the maximum value of the width (W2) of the mounting guide 34 denotes a horizontal distance between an outer circumferential surface of a hook 37 provided under the mounting guide 34 and an inner circumferential surface of the mounting guide 34 in the cross-sectional view of FIG. 10.

The mounting guide 34 may include an inner portion 345, a front portion 342, a round portion 343, and an inclined portion 344 to form an outermost portion of the outer frame 14.

The inner portion 345 is formed to protrude further toward a front side of the door than a front surface of the outer frame 14. The front surface of the outer frame 14 may include a flat portion 15 to which a rear surface of the front glass 20 is attached.

The inner portion 345 is defined in a ring shape along a circumferential direction so as to surround an outer circumferential surface of the front glass 20.

The inner portion 345 may protrude forward from the outer portion of the outer frame 14 to cover at least part of the outer circumferential surface in a thickness direction of the front glass 20.

The front portion 342 is disposed further forward than the flat portion 15 of the outer frame 14. The front portion 342 may extend in a radial direction of the outer frame 14. The front portion 342 is defined in a plane. The front portion 342 may be disposed parallel to the flat portion 15 of the outer frame 14. The front portion 342 may be disposed perpendicular to an inner circumferential surface of the mounting guide 34.

The round portion 343 may be defined in an arc shape between the front portion 342 and the inclined portion 344 to distribute an external shock even when the external shock is applied from various angles, thereby minimizing the damage of the mounting guide 34 due to the external shock.

The round portion 343 is disposed at an outer side of the front portion 342 in a radial direction of the outer frame 14. The round portion 343 may be disposed to be rounded at an outer end of the front portion 342. The round portion 343 may be defined in a curved shape having a preset curvature. The round portion 343 may be defined in an arc shape. The round portion 343 may be formed in the shape of one-quarter circumference when dividing the circumference into four.

The inclined portion 344 may be defined to be inclined in a direction in which the diameter increases from the round portion 343 toward the inner frame 19. The inclined portion 344 may form an outer circumferential surface of a first hook of the outer frame 14.

The mounting guide 34 may be disposed to gradually increase in diameter from the front portion 342 to the inclined portion 344. The front portion 342, the round portion 343 and the inclined portion 344 define one mounting guide 34.

Each of the front portion 342, the round portion 343, and the inclined portion 344 may have a different radial width and length at the corresponding portion.

For example, the radial width of each portion of the mounting guide 34 may decrease from the front portion 342 to the inclined portion 344.

Here, the radial width of the front portion 342 is a radial distance between an outer circumferential end of the front portion 342 and the inner portion 345.

The radial width of the round portion 343 is a radial distance between an outer circumferential end of the round portion 343 and an outer circumferential end of the front portion 342.

The radial width of the inclined portion 344 is a radial distance between an outer circumferential end of the inclined portion 344 and an outer circumferential end of the round portion 343.

However, referring to the cross section of the mounting guide 34 in FIG. 10, an arc length of the round portion 343 may be larger than a radial length of the front portion 342.

Furthermore, an inclined length of the inclined portion 344 may be larger than a radial length of the front portion 342.

Meanwhile, a radial width from the inner portion 345 of the mounting guide 34 to each portion of the mounting guide 34 increases from the front portion 342 to the inclined portion 344.

In other words, a radial width between the inner portion 345 and an outer circumferential end of the inclined portion 344 is larger than that between the inner portion 345 and an outer circumferential end of the front portion 342.

In addition, a radial width between the inner portion 345 and an outer circumferential end of the round portion 343 is larger than that between the inner portion 345 and an outer circumferential end of the front portion 342.

A protruding length of the mounting guide 34 may be defined to cover at least ⅔ of the thickness of the front glass 20. Here, the protruding length of the mounting guide 34 denotes a protruding length of the inner portion 345 of the mounting guide 34.

This is because an external impact can be applied to an outer circumferential surface of the front glass 20, and the load of the front glass 20 cannot be sufficiently supported when the protruding length of the mounting guide 34 is too short.

Figure 7:
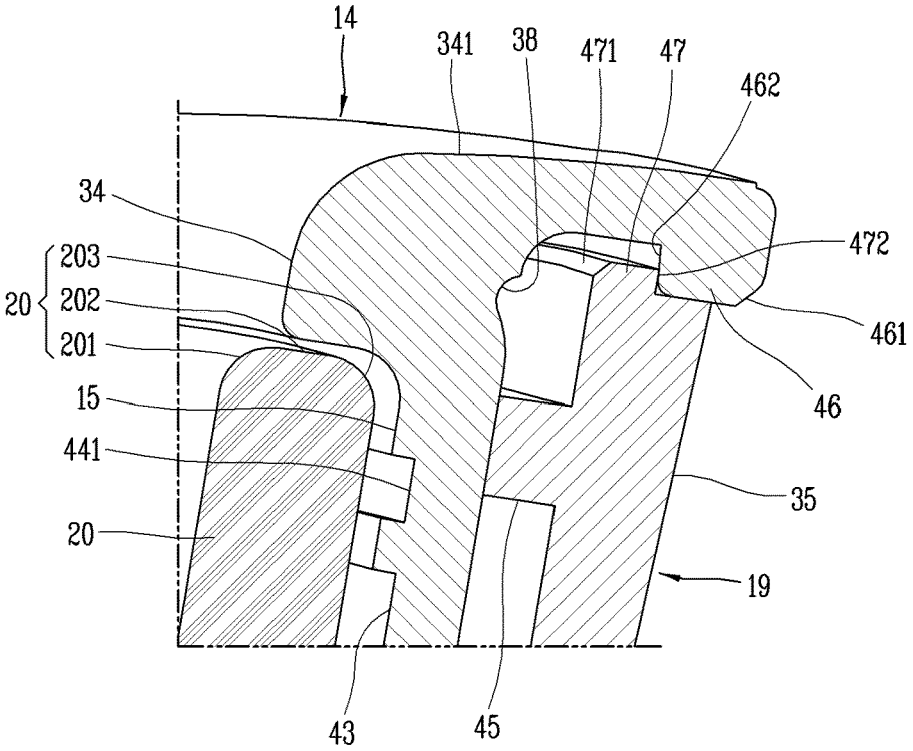
FIG. 7 is a conceptual view showing a hook fastening structure between an outer frame and an inner frame provided with a handle by taking a cross section along line VII-VII in FIG. 4.

For example, a straight portion 202 and a plurality of curved portions 201, 203 may be arranged on an outer circumferential surface of the front glass 20 (see FIG. 7). The plurality of curved portions 201, 203 may include a first curved portion 201 connected to a front surface of the front glass 20 and a second curved portion 203 connected to a rear surface of the front glass 20. Each of the curved portions 201, 203 has a preset curvature and is defined in a curved shape.

According to this configuration, the first curved portion 201 may extend forward in a curved shape in a thickness direction of the front glass, thereby increasing the strength of the front glass 20 compared to a glass having a rectangular cross-sectional shape.

In addition, the mounting guide 34 may protrude to cover the straight portion 202 and the second curved portion 203 without covering the first curved portion 201, thereby minimizing an area of the door frame 13.

In other words, the mounting guide 34 may reduce the area of the door frame 13 while protruding to cover part of an outer circumferential surface of the front glass 20.

The second curved portion 203 may be disposed symmetrically with the first curved portion 201 to allow assembly regardless of the direction, whether either one of the first curved portion 201 and the second curved portion 203 faces a front side of the outer frame 14 or a rear side of the outer frame 14, thereby having an advantage that the installation and assembly of the front glass 20 is convenient.

The straight portion 202 is disposed between the first and second curved portions 201, 203 and connected to the plurality of curved portions 201, 203, respectively. Each of the first curved portion 201, the straight portion 202, and the second curved portion 203 may be ⅓ of the thickness of the front glass 20.

The mounting guide 34 may be configured to cover the second curved portion 203 and the straight portion 202 of the front glass 20.

The mounting guide 34 may protrude from a front edge portion of the outer frame 14. The mounting guide 34 extends in a ring shape to define a space in which the front glass 20 is accommodated.

The mounting guide 34 has a preset inner diameter to define a circle. An inner diameter of the mounting guide 34 corresponds to an outer diameter of the front glass 20, and thus the mounting guide 34 is configured to surround an outer circumferential surface of the front glass 20.

The mounting guide 34 may be disposed to protrude to a predetermined thickness so as to define the same plane as the front surface of the front glass 20. According to this configuration, a step between the mounting guide 34 and the front glass 20 may be eliminated to implement a simpler appearance.

The transparent region 21 and the non-transparent region 22 may be disposed at inner and outer sides of the front glass 20, respectively.

The transparent region 21 denotes a region configured to transmit at least part of light so that the opposite side to the inside can be seen. Therefore, the transparent region 21 is a concept including a translucent region 21.

The transparent region 21 may be disposed to correspond to the opening portion 18 of the outer frame 14, the opening portion 18 of the inner frame 19, and the door window 23. Therefore, while the door 12 is closed, the user may look into the laundry accommodating portion through the transparent region 21.

The center of the transparent region 21 is located at a position corresponding to the center of the opening portion 18 of each of the outer frame 14 and the inner frame 19. Here, the corresponding position includes not only the perfect coincidence of the center, but also the same in the eccentric direction of the center. In other words, the center of the transparent region 21 and the center of the opening portion 18 may coincide, and the eccentric direction of the transparent region 21 may be the same as the eccentric direction of the opening portion 18.

In the present embodiment, it is shown that the center of the opening portion 18 is eccentrically located from the center of the door frame 13 to the upper side (12 o'clock direction), and correspondingly, the center of the transparent region 21 is also located from the center of the front glass 20 to the upper side (12 o'clock direction). Here, the center of the transparent region 21 and the center of the opening portion 18 may coincide.

The non-transparent region 22 is disposed to surround the transparent region 21, and the non-transparent region 22 does not transmit light therethrough, and the glass itself may appear black.

The non-transparent region 22 may be disposed to cover the remaining portion of the door frame 13 except for the opening portion 18 and part of the door frame 13.

A boundary line between the transparent region 21 and the non-transparent region 22 surrounding the transparent region 21 may be clearly distinguished by the non-transparent region 22.

Alternatively, the boundary between the transparent region 21 and the non-transparent region 22 may be blurred through a halftone technique, thereby allowing a movement from the transparent region 21 to the non-transparent region 22 to be visually transitioned. To this end, the non-transparent region 22 may include a plurality of shielding dots arranged around the transparent region 21, and the plurality of shielding dots may be arranged to have a lower density toward the transparent region 21.

The outer frame 14 may include a flat portion 15 and a curved portion 16.

The flat portion 15 may be in contact with a rear surface of the front glass 20, and part of the flat portion 15 may be disposed to overlap with the non-transparent region 22. An adhesive may be applied to the flat portion 15 so that the front glass 20 can be adhered to the flat portion 15.

A filling groove 43 for filling an adhesive on a front surface of the flat portion 15 of the outer frame 14 may be concave in a thickness direction of the flat portion 15 on the front surface of the flat portion 15.

The adhesive may be accommodated in the adhesive filling groove 43, and a rear surface of the front glass 20 may be adhered to the flat portion 15 by the adhesive.

The adhesive may overflow to the outside or the inside of the adhesive filling groove 43 when the adhesive filling groove 43 is filled. In order to accommodate the adhesive overflowing from the adhesive filling groove 43 therein, adhesive overflow grooves 441, 442 may be disposed to be concave in a ring shape on the inside and the outside of the adhesive filling groove 43, respectively (see FIG. 6).

The adhesive filling groove 43 and the plurality of adhesive overflow grooves 441, 442 may extend in a circumferential direction of the outer frame 14.

The adhesive filling groove 43 and the plurality of adhesive overflow grooves 441, 442 may be disposed outside the flat portion 15.

The non-transparent region 22 of the front glass 20 may be disposed to cover the adhesive filling groove 43 and the adhesive overflow grooves 441, 442 of the flat portion 15.

The plurality of adhesive overflow grooves 441, 442 may include a first adhesive overflow groove 441 and a second adhesive overflow groove 444.

The first adhesive overflow groove 441 may be defined in a ring shape on an outer side of the adhesive filling groove 43 in a radial direction. The second adhesive overflow groove 442 may be defined in a ring shape at an inner side of the adhesive filling groove 43. The plurality of adhesive overflow grooves 441, 442 accommodate the adhesive when the adhesive overflows after filling in the filling groove 43.

A plurality of water drain holes 48 may be arranged in a penetrating manner at a lower side of the flat portion 15 in a thickness direction to discharge water or moisture formed between a rear surface of the front glass 20 and a front surface of the outer frame 14 to an outside of the door 12 through the water drain holes 48.

The curved portion 16 may be defined to be curved in an arc shape having a predetermined curvature toward an outer circumference of the opening portion 18 of the inner frame 19 from an inner end of the flat portion 15. An inner portion of the flat portion 15 and the curved portion 16 may be disposed to overlap with an outer edge portion of the transparent region 21. The opening portion 18 may be disposed at an inner side of the curved portion 16 in a radial direction.

The mounting guide 34 may protrude from the flat portion 15 along a circumferential direction at the outermost portion of the flat portion 15. The mounting guide 34 of the outer frame 14 may be configured to surround an outer edge of the front glass 20, thereby preventing the outer edge of the front glass 20 from be released radially outward from the flat portion 15 of the outer frame 14.

A plating layer 17 may be disposed on front and outer circumferential surfaces of the outer frame 14 by chromium plating. The outer frame 14 is completely immersed in a chromium plating solution, and thus the plating layer 17 may be disposed on the entire surface of the outer frame 14 by chromium plating.

The plating layer 17 is configured to coat the outer frame 14 with a silver polished metal color. According to this, the plating layer 17 may obtain an effect which looks like a circular droplet by bright silver. In addition, the plating layer 17 may cause a sense of high quality and the like when viewed with the naked eye.

The door window 23 may be disposed to correspond to the laundry input port 102 while the door 12 is closed. The door window 23 may be mounted to the door frame 13 to correspond to the opening portion 18 of the inner frame 19.

The door window 23 is made of a transparent material, for example, a synthetic resin material having a light transmitting property, so that an inner space of the laundry accommodating portion such as a drum can be visually seen through the door window 23. The door window 23 may not be necessarily limited to a synthetic material but may also be made of a glass material.

An outer edge portion of the door window 23 may be inserted and coupled between the outer frame 14 and the inner frame 19.

The outer edge portion of the door window 23 may have a flat shape, and may be disposed and fixed between a rear end of the curved portion 16 of the outer frame 14 and an inner end of the inner frame 19.

Part of the outer frame 14 and the inner frame 19 may protrude forward from the recess portion 103 in the closed state of the door 12, and the other part of the outer frame 14 and the inner frame 19 may be provided to be accommodated in the recess portion 103.

The flat portion 15 of the outer frame 14 may be disposed outside the recess portion 103, but may protrude forward from the recess portion 103, and a rear end portion of the curved portion 16 of the outer frame 14 may be accommodated inside the recess portion 103.

A front portion of an outer circumference of the inner frame 19 may protrude outward from the recess portion 103, and a rear portion of the outer circumference portion of the inner frame 19 may be accommodated in the recess portion 103.

The front glass 20 may be spaced apart in an outward-forward direction from the recess portion 103, and disposed vertically.

The door 12 may be rotatably provided in a front-rear direction with respect to the main body 10 by the hinge unit 24.

The hinge unit 24 may include a hinge 25, a hinge holder 28, and a bush 29.

The hinge 25 may be fixed to the main body 10, and rotatably coupled to the door frame 13. The hinge 25 may include a plate-shaped base portion 26 coupled to the main body 10, and a rotation coupling portion 27 protruding from the base portion 26 and rotatably coupled to the door frame 13. A plurality of rotation coupling portions 27 may be provided and spaced apart in a vertical direction.

The hinge holder 28 may be coupled to the door frame 13 to support the rotation coupling portions 27 to prevent the rotation coupling portion 27 from being released from the door frame 13.

A bush 29 may be inserted into the rotating shaft of the rotary coupling portion 27 to efficiently rotate the rotating shaft.

The hinge unit 24 may be mounted at one side of the door 12, and the locking unit 30 may be provided at the other side of the door 12. The locking unit 30 is configured to lock or unlock the door 12 to the body 10.

The locking unit 30 may include a shaft 31, a door latch 32 (door latch) and a spring 33.

The shaft 31 may be configured to pass through the door latch 32, and mounted on the door frame 13. The spring 33 has an elastic force to be retractable during the rotation of the door latch 32.

According to this configuration, the door latch 32 may be configured to be rotatable and restorable to the door frame 13 so as to lock or unlock the door 12 to the main body 10.

Figure 4:
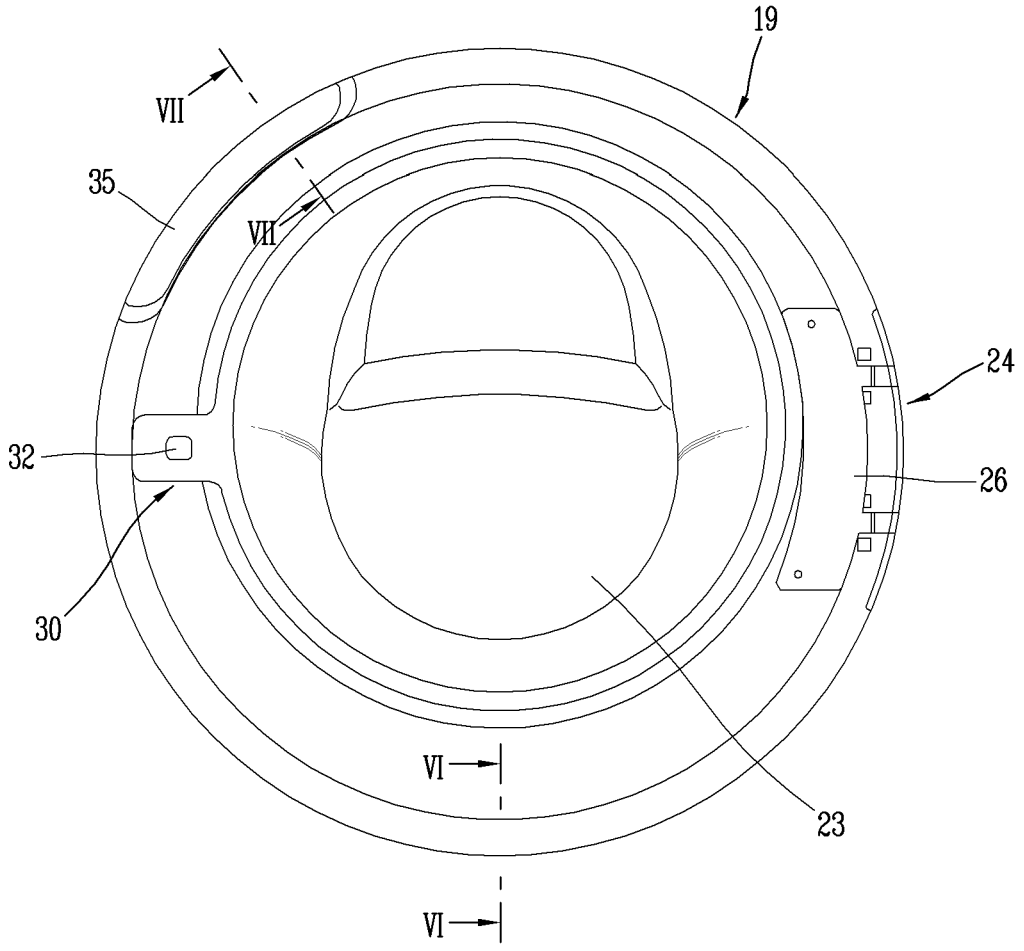
FIG. 4 is a conceptual view showing a rear surface of the door in FIG. 2.
Figure 6:
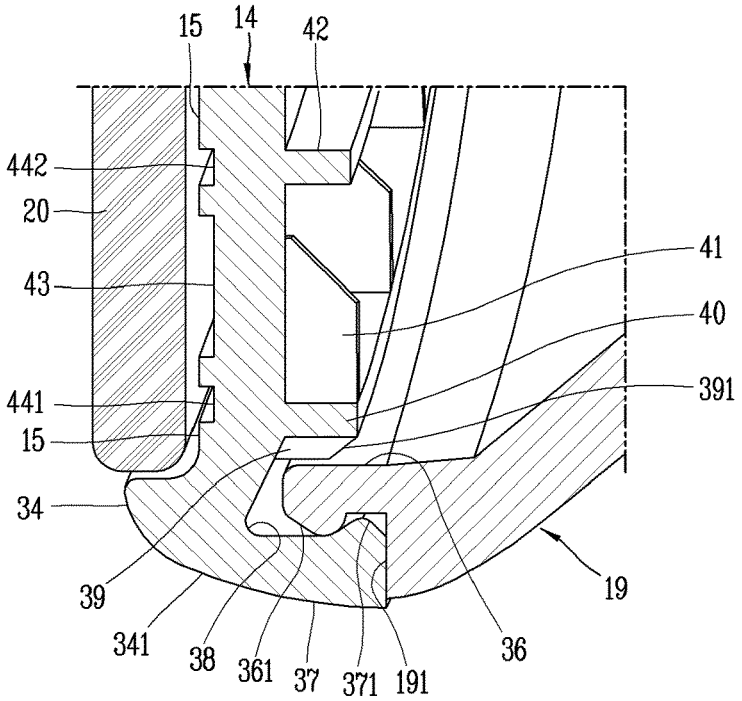
FIG. 6 is a conceptual view showing a hook fastening structure between an outer frame and an inner frame by taking a cross section along line VI-VI in FIG. 4.
Figure 8:
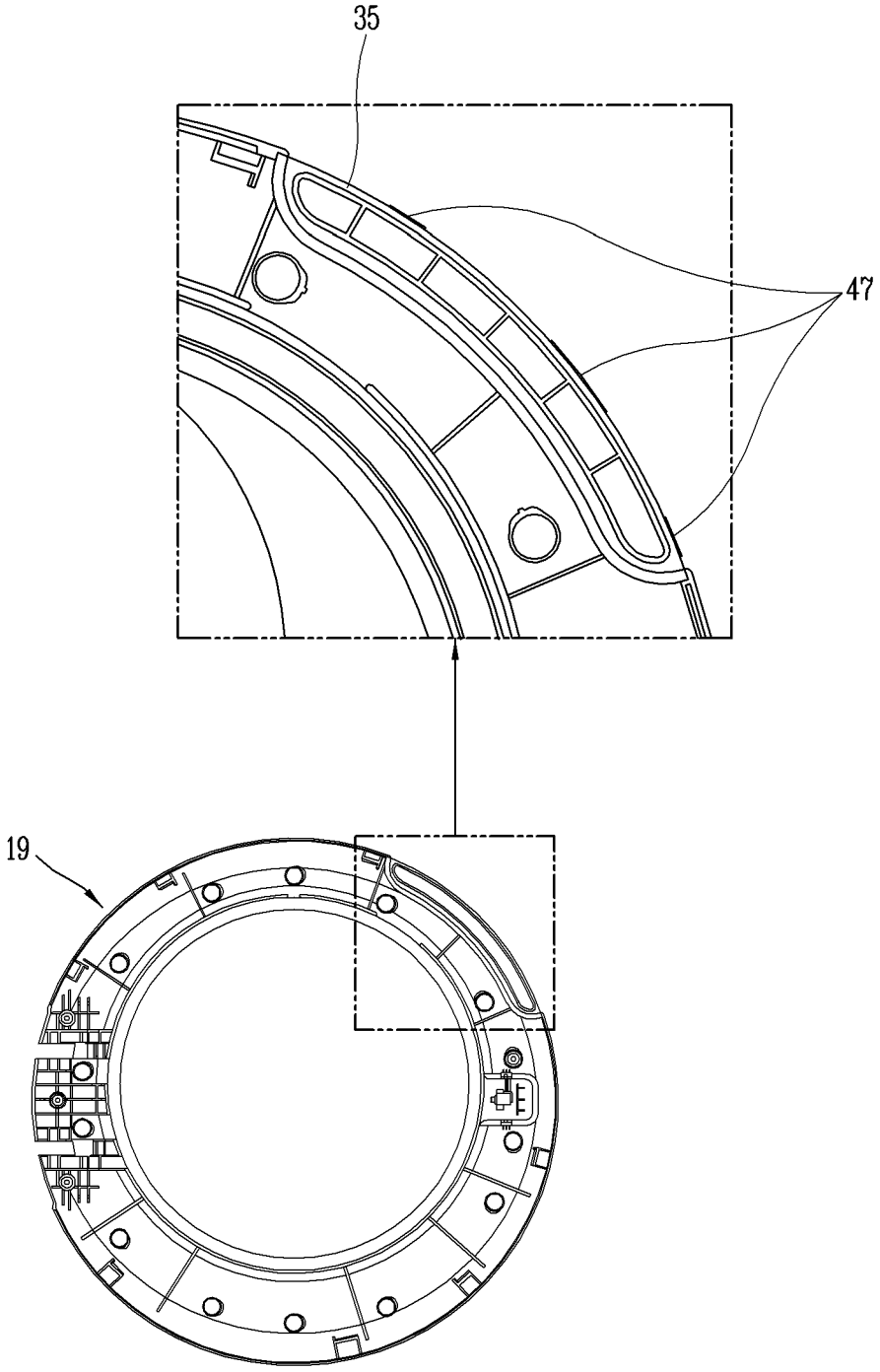
FIG. 8 is a conceptual view showing a state in which a hook is partially disposed on the handle as the inner frame in FIG. 4 is seen from the front.

FIG. 4 is a conceptual view showing a rear surface of the door 12 in FIG. 2, and FIG. 5 is a cross-sectional view showing a state in which the door 12 is mounted on the front panel 101 of the main body 10 to close the laundry input port 102, and FIG. 6 is a conceptual view showing a hook fastening structure between the outer frame 14 and the inner frame 19 by taking a cross section along line VI-VI in FIG. 4, and FIG. 7 is a conceptual view showing a hook fastening structure between the outer frame 14 and the inner frame 19 provided with a handle 35 by taking a cross section along line VII-VII in FIG. 4, and FIG. 8 is a conceptual view showing a state in which a hook is partially disposed on the handle 35 as the inner frame 19 in FIG. 4 is seen from the front.

FIG. 5 shows a state in which the control unit of FIG. 1 is removed from an upper side of the front panel 101.

Referring to FIGS. 4 and 5, the handle 35 is disposed in a recessed manner on a rear upper side of the inner frame 19 for the user to open the door 12 by pulling the handle 35.

A rear surface of the inner frame 19 may be defined to be convex rearward in a curved shape.

The handle 35 is provided on the door 12 for the user to open and close the door 12. In the related art, the handle is generally provided at a front side of the door. However, in the present disclosure, since the front glass 20 is provided to cover a front surface of the door 12, it is difficult to provide the handle 35 on the front glass 20.

Thus, the handle 35 is not provided on the front surface of the door 12 due to the front glass 20, and preferably provided on a rear surface of the door 12. The handle 35 is provided on the inner frame 19.

In addition, the handle 35 is preferably provided at an upper portion of the door 12 for the user to easily pull the door 12. Because, when the handle 35 is provided at a lower portion of the door 12, the user has to bend his or her waist and knees more to pull the handle 35.

Moreover, since the hinge unit 24 and the locking unit 30 are respectively provided at left and right sides of the door frame 13 along a horizontal center line that horizontally passes through the center of the door frame 13 in a radial direction, they are preferably positioned higher than the horizontal center line.

In addition, the handle 35 is preferably disposed above the door frame 13 to be higher than the locking unit 30 in order to open and close the door 12 with a little force.

The handle 35 may be disposed at an rear upper side of the inner frame 19. While the door 12 is closed, the handle 35 may be disposed at an upper right side to be higher than the locking unit 30 when viewed from the front of the main body 10, that is, within a section between 1 o'clock and 3 o'clock along a circumferential direction in a clockwise direction.

The handle 35 may be disposed in a recessed manner on a rear surface of the inner frame 19. The handle 35 may be defined in an arc shape along a partial section in a circumferential direction on a rear surface of the inner frame 19.

The handle 35 may be defined in a thin and flat shape compared to an outer circumference of the inner frame 19 (a portion other than the handle 35).

According to this configuration, when the door 12 is closed by the user, the handle 35 is recessed forward compared to a rear outer circumference of the inner frame 19 and defined in a flat shape when viewed from the front of the main body 10, thereby facilitating the insertion of the user's hand into the handle 35 as well as facilitating the identification of the position of the handle 35 in the closed state of the door 12.

In order to fasten the outer frame 14 and the inner frame 19 to each other, hooks 37, 36 are disposed on the outer frame 14 and the inner frame 19, respectively.

The hooks 37, 36 may include a first hook 37 provided on the outer frame 14 and a second hook 36 provided on the inner frame 19. Each of the first hook 37 and the second hook 36 may be defined in a ring shape along a circumferential direction.

The first hook 37 may protrude from the outer frame 14 toward the inner frame 19. The first hook 37 may be disposed outside in a radial direction of the mounting guide 34 to surround the outer circumference of the inner frame 19. The first hook 37 may be disposed outside the mounting guide 34 when viewed from the front of the main body 10.

The mounting guide 34 and the first hook 37 are integrally connected by the extension portion 341. The extension portion 341 extends from the mounting guide 34 to the first hook 37. The extension portion 341 extends from the mounting guide 34 to the first hook 37 to gradually increase in diameter. The extension portion 341 is defined in a curved shape.

Each of the mounting guide 34, the first hook 37, and the extension portion 341 extends along a circumferential direction of the outer frame 14.

According to this configuration, the mounting guide 34, the extension portion 341 and the first hook 37 may define the outer circumferential surface of the outer frame 14 in one curved shape to cover the inner frame 19 so as to cover up the main body 10 when seen from the front of the main body 10, thereby beautifying the appearance of the door 12. Each of the mounting guide 34, the extension portion 341 and the first hook 37 may be defined in a curved or inclined surface shape so that the diameter increases gradually from the mounting guide 34 to the first hook 37 without wrinkles or steps.

The first hook 37 and the second hook 36 may be disposed to radially overlap with each other.

The first hook 37 may have a larger diameter than the second hook 36, and the second hook 36 may be inserted into the first hook 37.

A mounting groove 191 may be disposed between an outer circumferential end of the inner frame 19 and the second hook 36 along a circumferential direction. The second hook 36 is disposed in a stepped manner radially inward from the outer circumferential end of the inner frame 19. A radial height of the mounting groove 191 may be disposed to be the same or similar to a thickness of the first hook 37.

According to this, after the outer frame 14 and the inner frame 19 are fastened to each other, a step is eliminated between an outer circumferential end of the first hook 37 and an outer circumferential end of the inner frame 19, thereby beautifying the appearance of the door 12.

The first hook 37 protrudes backward from an outer circumference of the outer frame 14 toward the inner frame 19. A hook protrusion 371 may protrude radially inward toward the second hook 36 on an inner circumferential surface of the first hook 37.

The second hook 36 protrudes forward from an outer circumference of the inner frame 19 toward the outer frame 14. A hook protrusion 361 may protrude radially outward toward the first hook 37 on an outer circumferential surface of the second hook 36. The hook protrusion 371 of the first hook 37 and the hook protrusion 361 of the second hook 36 may protrude parallel to each other in a radial direction.

The hook protrusions 371, 361 may be defined in a wedge shape at each end portion of each of the first hook 37 and the second hook 36. The hook protrusion 371 of the first hook 37 and the hook protrusion 361 of the second hook 36 may be disposed to overlap with each other in an axial direction. The hook protrusions 371, 361 facilitate engagement between the first hook 37 and the second hook 36 toward each other but do not allow them from being released from each other in opposite directions.

Each of the hook protrusion 371 of the first hook 37 and the hook protrusion 361 of the second hook 36 may be configured with a first inclined surface in contact with each other prior to fastening and a second inclined surface disposed to be inclined on an opposite side of the first inclined surface to be in contact with each other subsequent to fastening. The first inclined surface and the second inclined surface change the slopes of the hook protrusions 371, 361 in opposite directions with respect to the vertices of the hook protrusions 371, 361, respectively.

The slopes of the first inclined surface and the second inclined surface may be different from each other. The first inclined surface of each of the hook protrusions 371, 361 facing each other prior to fastening may be disposed to have a lower slope than the second inclined surface of each of the hook protrusions 371 and 361 facing each other subsequent to fastening.

In other words, the second inclined surface of each of the hook protrusions 371 and 361 facing each other subsequent to fastening is disposed to have a higher slope than the first inclined surface of each of the hook protrusions 371, 361 facing each other prior to fastening.

According to this configuration, the first hook 37 and the second hook 36 may move toward each other in an axial direction to engage the hook protrusions 371, 361 with each other, thereby fastening the outer frame 14 and the inner frame 19.

Moreover, the wedge-shaped hook protrusions 371, 361 may facilitate engagement between the first hook 37 and the second hook 36 toward each other but prevent them from being released from each other in opposite directions as long as there is no damage of the first hook 37 or the second hook 36.

In other words, when the first hook 37 and the second hook 36 move toward each other in an axial direction to fasten the outer frame 14 and the inner frame 19, a movement resistance between the hook protrusions 371, 361 prior to fastening may be reduced, and the hook protrusions 371, 361 may be restricted from moving in a direction of being released from each other while the second inclined surfaces are brought into contact with each other subsequent to fastening the first hook 37 and the second hook 36.

The outer frame 14 is provided with an elastic groove 38 and a pressing portion to support the heavy load front glass 20 and to firmly maintain a hook fastening structure between the outer frame 14 and the inner frame 19.

The pressing portion may include a plurality of pressing ribs 39, connecting ribs 40, and support ribs 41.

The elastic groove 38 may be disposed radially inward from the first hook 37 on a rear surface of the outer frame 14. The elastic groove 38 may be disposed to be concave in a thickness direction of the flat portion 15 on a rear surface of the flat portion 15 of the outer frame 14.

The elastic groove 38 is configured to be more concave in a thickness direction of the flat portion 15 at an inner side of the first hook 37 to decrease the thickness of the first hook 37, thereby allowing the first hook 37 to be elastically deformed radially outward.

According to this configuration, when the second hook 36 enters an inner side of the first hook 37 in an axial direction, the hook protrusion 371 of the first hook 37 may spread outward in a radial direction while the hook protrusion 371 of the first hook 37 and the hook protrusion 361 of the second hook 36 are brought into contact with each other, thereby facilitating the the hook protrusion 361 of the second hook 36 to enter an inside of the hook protrusion 371 of the first hook 37.

In addition, as a radial pressing force between the hook protrusion 371 of the first hook 37 and the hook protrusion 361 of the second hook 36 is released while the hook protrusion 361 of the second hook 36 passes through the highest point of the hook protrusion 371 of the first hook 37, the first hook 37 is restored to its original position from the deformed position, thereby allowing the hook protrusion 371 of the first hook 37 and the hook protrusion 361 of the second hook 36 to be engaged with each other.

A plurality of pressing ribs 39 may be arranged on a rear surface of the flat portion 15. The pressing ribs 39 are configured to protrude from a rear surface of the flat portion 15 to be brought into contact with an inner circumferential surface of the second hook 36 so as to press the second hook 36 when fastening between the first hook 37 and the second hook 36. The pressing ribs 39 may be arranged to be spaced apart from each other in a circumferential direction of the flat portion 15.

According to this configuration, the pressing ribs 39 press an inner circumferential surface of the second hook 36 radially outward when fastening between the first hook 37 and the second hook 36. Accordingly, since the second hook 36 is not pushed inward in a radial direction, a fastening state between the outer frame 14 and the inner frame 19 may be firmly maintained without being axially released from each other after the hook protrusions 361, 371 of each of the first hook 37 and the second hook 36 are fastened to each other.

In addition, the pressing ribs 39 may press the second hook 36, thereby enhancing a coupling force between the outer frame 14 and the inner frame 19.

The pressing ribs 39 are located radially inward from the elastic grooves 38 on a rear surface of the outer frame 14.

An entry guide surface 391 may be disposed to be inclined toward the elastic groove 38 on a rear surface of the pressing rib 39. The entry guide surface 391 may guide the movement of the second hook 36 to guide the second hook 36 to be inserted between the pressing rib 39 and the first hook 37.

The entry guide surface 391 may facilitate the entry of second hook 36 into first hook 37, thereby improving assembly performance.

The connecting rib 40 may protrude in a rearward direction on a rear surface of the outer frame 14, and may extend along a circumferential direction in a ring shape. The connecting rib 40 is configured to connect the plurality of pressing ribs 39.

The connecting rib 40 may protrude from an opposite side of the first adhesive overflow groove 441 toward the inner frame 19 on a rear surface of the flat portion 15.

Some or all of the connecting ribs 40 may be disposed to overlap in a thickness direction of the first adhesive overflow groove 441 and the flat portion 15.

According to this configuration, the connecting rib 40 may reinforce the reduction of rigidity caused by a smaller thickness of one side of the flat portion 15 due to the adhesive overflow groove 441.

The elastic groove 38 may be disposed between the connecting rib 40 and the first hook 37. The elastic groove 38 may have an inner inclined surface disposed to be inclined so that a thickness of the flat portion 15 gradually decreases from the connecting rib 40 to the first hook 37.

A plurality of support ribs 41 may protrude from a rear surface of the outer frame 14. The plurality of support ribs 41 may have a trapezoidal plate structure to extend vertically in a radial direction.

The plurality of support ribs 41 may be spaced apart in a circumferential direction. One side of each of the plurality of support ribs 41 may be integrally connected to a rear surface of the flat portion 15. An outer surface perpendicular to one side of the support ribs 41 is integrally connected to the connecting rib 40, and thus the plurality of support ribs 41 may be connected to one another by the connecting rib 40. The other side of the support ribs 41 positioned on a side opposite to the one side of the support ribs 41 may be disposed in parallel to the flat portion 15.

According to this configuration, the plurality of support ribs 41 may be integrally arranged to be in direct contact with an inner surface of the connecting rib 40 and the flat portion 15 so as to firmly support the connecting rib 40 and the pressing ribs 39.

The plurality of pressing ribs 39 and the plurality of support ribs 41 may be disposed to face each other in a radial direction inner and outer sides of the connecting rib 40 by interposing the connecting rib 40 therebetween.

The plurality of support ribs 41 may be arranged to overlap with each other in a thickness direction of the adhesive filling groove 43 and the flat portion 15 on a rear surface of the flat portion 15.

According to this configuration, the support ribs 41 may compensate for the weakening of the rigidity of the flat portion 15 due to the adhesive filling groove 43.

A reinforcing rib 42 may protrude from an opposite side of the second adhesive overflow groove 442 disposed at an inner side of the adhesive filling groove 43 between a plurality of adhesive overflow grooves 441, 442 on a rear surface of the flat portion 15.

The reinforcing rib 42 may be disposed to overlap with the second adhesive overflow groove 442 in a thickness direction of the flat portion 15.

According to this configuration, the reinforcing rib 42 may compensate for the weakening of the flat portion 15 due to the adhesive overflow groove.

The handle 35, which is part of the inner frame 19, has a lower thickness than a portion other than the handle 35 on an outer edge portion of the inner frame 19. The handle 35 does not axially cover an outer surface of the first hook 37 of the outer frame 14.

Due to this, a hook fastening structure between the handle 35 and the outer frame 14 is somewhat different from a hook fastening structure between the inner frame 19 and the outer frame 14.

A plurality of second hooks 47 of the handle 35 may be spaced apart in a circumferential direction of the handle 35.

Each of the plurality of second hooks 47 arranged on the handle 35 may have different lengths in a circumferential direction.

The first hook 46 of the outer frame 14 and the second hook 47 of the handle 35 may protrude in parallel to each other in a radial direction.

The first hook 46 of the outer frame 14 may protrude radially inward from an inner circumferential surface of the outer frame 14, and the second hook 47 of the handle 35 may protrude radially outward from an outer circumferential surface of the handle 35.

The first hook 46 of the outer frame 14 and the second hook 47 of the handle 35 may be disposed to overlap in a thickness direction of the handle 35 to engage with each other in the thickness direction when the outer frame 14 and the inner frame 19 are fastened to each other.

A chamfer part 461 may be disposed to be inclined at a preset angle at one edge of the first hook 46. A contact portion 462 may be disposed substantially vertically at the other side of the first hook 46.

The chamfer part 471 may be disposed to be inclined at a preset angle at one edge of the second hook 47 of the handle 35. The contact portion 472 may be disposed substantially vertically at the other side of the second hook 47 of the handle 35.

According to this configuration, when the outer frame 14 and the inner frame 19 are fastened to each other in a front-rear direction (axial direction), the chamfer parts 461, 471 are in contact with each other, thereby facilitating the second hook 47 of the handle 35 to enter an inside of the first hook 46 of the outer frame 14.

In addition, subsequent to fastening the outer frame 14 and the handle 35, the contact portions 462, 472 of each of the first hook 46 of the outer frame 14 and the second hook 47 of the handle 35 are in contact with each other substantially vertically, thereby preventing them from being released from each other.

The elastic groove 38 is disposed to be concave in a thickness direction on a rear surface of the flat portion 15 of the outer frame 14, and thus the first hook 46 is elastically deformable radially outward by the elastic groove 38 when the first hook 46 is inserted into and coupled to an inside of the second hook 47.

Moreover, the second hook 36 may easily enter an inside of the first hook 37 by the chamfer parts 461, 471.

Besides, the first hook 37 and the second hook 36 may be prevented from being released from each other by the contact portions 462, 472.

A reinforcing rib 45 may protrude toward the second adhesive overflow groove 442 at one side of the handle 35.

The reinforcing rib 42 may be disposed to be in contact with an opposite side of the second adhesive overflow groove 442. The reinforcing rib 45 of the handle 35 may compensate for the weakening of the strength of the flat portion 15 caused by a smaller thickness of the flat portion 15 due to the second adhesive overflow groove 442.

In addition, the reinforcing rib 42 may serve as a spacer for maintaining a constant gap between the handle 35 and the flat portion 15, thereby reducing the thickness of the handle 35.

Moreover, the reinforcing rib 42 may not only reinforce the strength of the handle 35 even when the thickness of the handle 35 is reduced, but also maintain a contact state between the contact portion 462 of the first hook 46 and the contact portion 472 of the second hook 47.

Accordingly, coupling and assembly performance between the outer frame 14 and the inner frame 19 may be improved by a fastening structure between the first hook 46 of the outer frame 14 and the second hook 47 of the handle 35.

What is claimed is:

1. A clothes processing apparatus, comprising:

a main body comprising a front panel that defines a laundry inlet port and a drum configured to receive laundry through the laundry inlet port; and a door disposed at the front panel and configured to rotate relative to the front panel to thereby open and close the laundry inlet port, wherein the door comprises:

an outer frame that defines an opening and faces an outer side of the main body, a front glass that is coupled to a front surface of the outer frame and covers the opening, an inner frame that is coupled to a rear surface of the outer frame and faces an inner side of the main body, and a mounting guide that protrudes from an outer circumferential portion of the outer frame and surrounds at least a portion of an outer circumferential surface of the front glass, the mounting guide defining a gap between an inner circumferential surface of the mounting guide and the outer circumferential surface of the front glass, and wherein the front glass protrudes forward relative to the mounting guide, and wherein the mounting guide comprises:

an inner portion that protrudes toward the front surface of the outer frame in a thickness direction of the front glass and covers a part of the outer circumferential surface of the front glass, the inner portion having a protrusion length in the thickness direction of the front glass, a front portion that extends in a radial direction from the inner portion, and a round portion that extends from the front portion in an arc shape toward the inner frame, wherein a radius of curvature of the round portion is less than or equal to the protrusion length of the inner portion.

2. The clothes processing apparatus of claim 1, wherein the gap is 0.1 mm to 1.0 mm.

3. The clothes processing apparatus of claim 1, wherein the gap is 0.5 mm to 0.7 mm.

4. The clothes processing apparatus of claim 1, wherein the mounting guide is a part of the outer frame and made of a plastic material by injection molding.

5. The clothes processing apparatus of claim 1, wherein the mounting guide has a ring shape.

6. The clothes processing apparatus of claim 5, wherein a radial width of the mounting guide is 1.5 mm to 6.0 mm, and wherein the radial width of the mounting guide is one half of a difference between an outer diameter of the mounting guide and an inner diameter of the mounting guide.

7. The clothes processing apparatus of claim 6, wherein the radial width of the mounting guide is 2.5 mm to 4.5 mm.

8. The clothes processing apparatus of claim 5, wherein the mounting guide defines an outermost portion of the outer frame, wherein the front portion of the mounting guide has a flat shape, wherein the mounting guide further comprises an inclined portion that is inclined with respect to the front portion and extends from the round portion toward the inner frame, and wherein the round portion and the inclined portion define an outer diameter of the mounting guide that increases toward the inner frame.

9. The clothes processing apparatus of claim 8, wherein a radial width between the inner portion and an outer circumferential end of the front portion is 2.5 mm or more, wherein a radial width between the inner portion and an outer circumferential end of the inclined portion is 4.5 mm or less, and wherein a radial width between the outer circumferential end of the front portion and an outer circumferential end of the round portion is 2 mm or less.

10. The clothes processing apparatus of claim 8, wherein a radial width of the front portion, an arc length of the round portion, and a length of the inclined portion are different from one other, and wherein the arc length of the round portion is greater than the radial width of the front portion, and the length of the inclined portion is greater than the radial width of the front portion.

11. The clothes processing apparatus of claim 8, wherein radial widths of the front portion, the round portion, and the inclined portion are different from one another, and wherein a radial width between the inner portion and an outer circumferential end of the inclined portion is greater than a radial width between the inner portion and an outer circumferential end of the front portion.

12. The clothes processing apparatus of claim 1, wherein the door further comprises a flat portion disposed at the front surface of the outer frame, the flat portion defining an adhesive filling groove that receives an adhesive attached to the front glass, and wherein the mounting guide is disposed perpendicular to the flat portion.

13. The clothes processing apparatus of claim 1, wherein a thickness of the mounting guide is greater than or equal to two thirds of a thickness of the front glass.

14. The clothes processing apparatus of claim 8, wherein a length of the inner portion in the thickness direction of the front glass is greater than or equal to at least two thirds of a thickness of the front glass.

15. The clothes processing apparatus of claim 8, wherein the front glass comprises a first curved portion that is disposed at a front edge of the front glass and a straight portion that extends from the first curved portion toward a rear side of the front glass in the thickness direction of the front glass, and wherein the inner portion covers at least a part of the straight portion.

16. The clothes processing apparatus of claim 15, wherein the mounting guide covers an entirety of the straight portion.

17. The clothes processing apparatus of claim 15, wherein the front glass further comprises a second curved portion that extends from the straight portion and is disposed at a rear edge of the front glass, wherein the first curved portion and the second curved portion are symmetrically disposed with respect to the radial direction of the front glass, wherein the first curved portion protrudes forward relative to a front end of the inner portion, and wherein the inner portion extends toward a front side of the front glass and covers the second curved portion and the straight portion.

18. The clothes processing apparatus of claim 1, wherein the front glass has a disc shape having front and rear surfaces that are flat.

19. The clothes processing apparatus of claim 1, wherein the outer frame comprises:

a flat portion comprising an adhesive filling portion that accommodates an adhesive attached to the front glass, and wherein the adhesive filling portion defines:

an adhesive filling groove filled with the adhesive; and a plurality of adhesive overflow grooves disposed radially spaced apart from one another and configured to accommodate the adhesive overflowing from the adhesive filling groove, the adhesive filling groove being disposed between the plurality of adhesive overflow grooves.

20. The clothes processing apparatus of claim 1, wherein the door further comprises:

a first hook that protrudes from the outer circumferential portion of the outer frame toward an outer circumferential portion of the inner frame; and a second hook that protrudes from the outer circumferential portion of the inner frame toward the outer circumferential portion of the outer frame, the second hook being coupled to and configured to interfere with the first hook.

* * * * *